US010871035B2

(12) United States Patent
Schultz et al.

(10) Patent No.: US 10,871,035 B2
(45) **Date of Patent: *Dec. 22, 2020**

(54) DOWNHOLE FORCE GENERATING TOOL

(71) Applicant: Thru Tubing Solutions, Inc., Oklahoma City, OK (US)

(72) Inventors: Roger Schultz, Newcastle, OK (US); Brock Watson, Oklahoma City, OK (US); Andy Ferguson, Moore, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/439,411

(22) Filed: Jun. 12, 2019

(65) Prior Publication Data

US 2019/0292855 A1 Sep. 26, 2019

Related U.S. Application Data

(63) Continuation of application No. 15/788,540, filed on Oct. 19, 2017, now Pat. No. 10,577,867, which is a (Continued)

(51) Int. Cl.

| | |
|---|---|
| ***E21B 4/18*** | (2006.01) |
| ***E21B 7/04*** | (2006.01) |
| ***E21B 17/22*** | (2006.01) |
| ***E21B 7/20*** | (2006.01) |
| ***E21B 17/10*** | (2006.01) |
| ***E21B 4/02*** | (2006.01) |
| ***E21B 23/04*** | (2006.01) |
| ***F04C 2/107*** | (2006.01) |
| ***F04C 13/00*** | (2006.01) |

(Continued)

(52) U.S. Cl.

CPC ..... *E21B 7/201* (2013.01); *E21B 4/02* (2013.01); *E21B 4/18* (2013.01); *E21B 7/20* (2013.01); *E21B 7/203* (2013.01); *E21B 17/046* (2013.01); *E21B 17/1021* (2013.01); *E21B 17/1064* (2013.01); *E21B 17/22* (2013.01); *E21B 23/04* (2013.01); *F04C 2/1073* (2013.01); *F04C 13/008* (2013.01); *E21B 23/001* (2020.05)

(58) Field of Classification Search

CPC ... E21B 4/18; E21B 4/006; E21B 7/04; E21B 12/04; E21B 14/1014; E21B 17/1021; E21B 17/1064; E21B 17/22

See application file for complete search history.

(56) References Cited

U.S. PATENT DOCUMENTS

| | | | |
|---|---|---|---|
| 2,592,519 | A | 4/1952 | Postelwaite |
| 3,405,912 | A | 10/1968 | Ion et al. |

(Continued)

OTHER PUBLICATIONS

"International Search Report and Written Opinion"; International Application No. PCT/US2014/067145; dated Mar. 5, 2015; 16 pages.

*Primary Examiner* — Cathleen R Hutchins

(74) *Attorney, Agent, or Firm* — Hall Estill Law Firm

(57) ABSTRACT

The disclosure of this application is directed to a downhole tool comprising a central element/member and a sleeve that is rotatably and orbitally disposed around the central element/member. The sleeve rotates and orbits around the central element/member responsive to fluid flowing through the downhole too. The disclosure is also related to a method of advancing the downhole tool in a well by flowing fluid through the tool.

6 Claims, 13 Drawing Sheets

Related U.S. Application Data continuation of application No. 14/828,157, filed on Aug. 17, 2015, now Pat. No. 9,840,873, which is a continuation of application No. 14/551,791, filed on Nov. 24, 2014, now Pat. No. 9,140,069.

(60) Provisional application No. 61/907,740, filed on Nov. 22, 2013.

(51) Int. Cl.
*E21B 17/046* (2006.01)
*E21B 23/00* (2006.01)

(56) References Cited

U.S. PATENT DOCUMENTS

| | | | |
|---|---|---|---|
| 4,049,066 | A | 9/1977 | Richey |
| 4,585,401 | A | 4/1986 | Baldenko |
| 4,809,682 | A | 3/1989 | Forssmann et al. |
| 5,090,497 | A | 2/1992 | Beimgraben et al. |
| 5,447,200 | A | 9/1995 | Dedora et al. |
| 2003/0056990 | A1 | 3/2003 | Oglesby |
| 2011/0094730 | A1 | 4/2011 | Johnson et al. |
| 2012/0228028 | A1 | 9/2012 | Turner et al. |
| 2013/0175093 | A1 | 7/2013 | Taylor et al. |

DOWNHOLE FORCE GENERATING TOOL

CROSS-REFERENCE TO RELATED APPLICATIONS

The present application is a continuation application of U.S. patent application having U.S. Ser. No. 15/788,540, filed Oct. 19, 2017, continuation application of U.S. patent application having U.S. Ser. No. 14/828,157, filed Aug. 17, 2015, which is a continuation application of U.S. patent application having U.S. Ser. No. 14/551,791, filed Nov. 24, 2014, which is a conversion of U.S. Provisional Application having U.S. Ser. No. 61/907,740, filed Nov. 22, 2013, which claims the benefit under 35 U.S.C. 119(e), the disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a downhole tool that creates downward force to advance a tubing string and/or bottom hole assembly (BHA) into a well.

2. Description of the Related Art

Various problems are encountered when attempting to advance a tubing string and/or bottom hole assembly (BHA) into a well. Vibratory tools have been used to help advance a tubing string and/or BHA into a well, but typical vibratory tools lack the ability to actually force the tubing string and/or BHA down into the well.

Accordingly, there is a need for a downhole tool that can be included in the BHA to force the BHA and/or tubing string down into the well.

SUMMARY OF THE DISCLOSURE

The disclosure of this application is directed to a downhole tool comprising a central element/member and a sleeve that is rotatably and orbitally disposed around the central element/member. The sleeve rotates and orbits around the central element/member responsive to fluid flowing through the downhole too. The disclosure is also related to a method of advancing the downhole tool in a well by flowing fluid through the tool.

DETAILED DESCRIPTION OF THE DISCLOSURE

Figure 1:
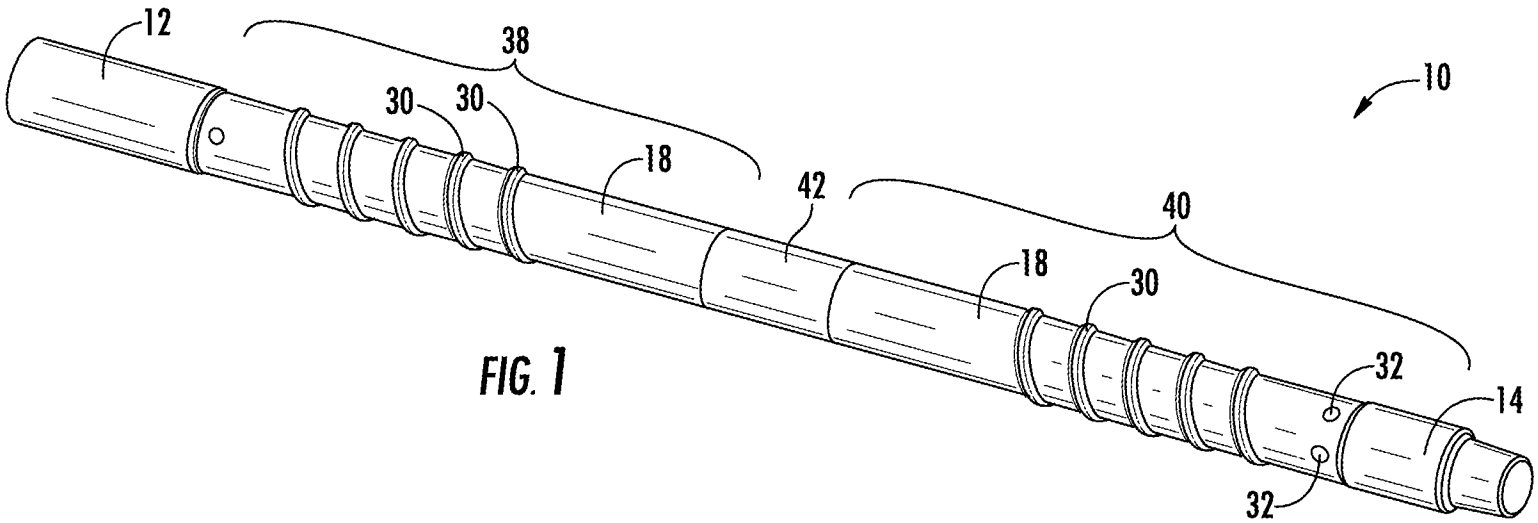
FIG. 1 is a perspective view of a downhole tool constructed in accordance with the present disclosure.

The present disclosure relates to a downhole tool 10 that creates downward force on a tubing string and/or a bottom hole assembly (BHA) to advance the tubing string and/or BHA into a well. In one embodiment of the present disclosure, shown in FIGS. 1 and 2, the downhole tool 10 can include a top adapter 12 for attachment to another tool in the BHA above the tool 10, a bottom adapter 14 for attachment to another tool in the BHA below the tool 10, a central member 16 attached to the top and bottom adapters 12,14 and a sleeve 18 rotatably disposed around at least a portion of the central member 16.

The central member 16 includes an internal passageway 20 in fluid communication with the top and bottom adapters 12,14, an outlet 22 for allowing a portion of the fluid passing into the internal passageway 20 to enter an annulus 24 disposed between the central member 16 and the sleeve 18, and a rotor profile 26 (similar to a rotor in a moineau principle pump/motor) disposed on the outside of the central member 16 to assist in rotating the sleeve 18 around the central member 16. It should be understood that the outlet 22 can be comprised of multiple openings disposed in the central member 16.

The sleeve 18 includes a stator profile 28 (similar to a stator in a moineau principle pump/motor) disposed on the inside of the sleeve 18 to engage the rotor profile 26 and force the sleeve 18 to rotate and orbit in an oscillating motion around the central member 16 as fluid flows between the sleeve 18 and central member 16, at least one engaging member 30 disposed on the outside of the sleeve 18 to engage a wellbore or casing disposed in the wellbore, and an exhaust port 32 disposed in the sleeve 18 for permitting fluid to pass from the annulus 24 outside of the tool 10. It should be understood that the exhaust port 32 can be comprised of multiple openings disposed in the sleeve 18.

Figure 3:
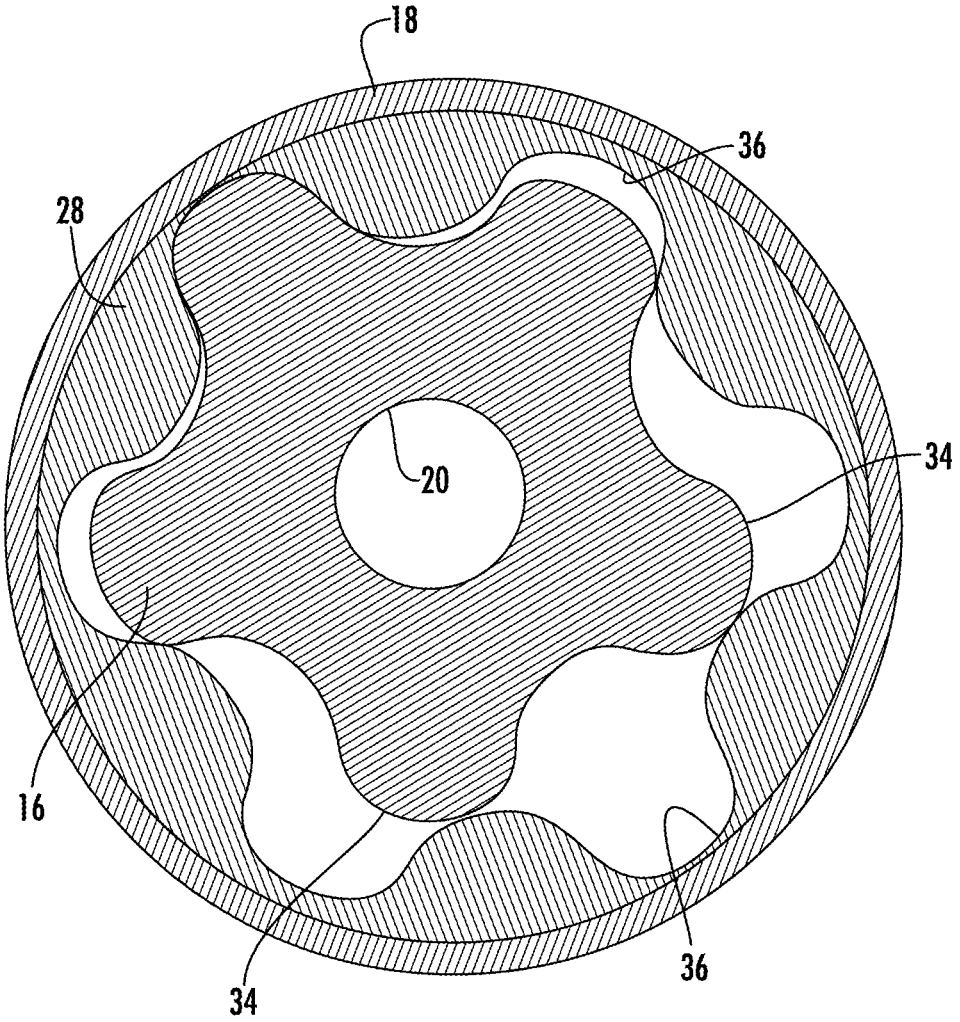
FIG. 3 is a cross-sectional view of a portion of the downhole tool across line 3-3 and constructed in accordance with the present disclosure.

The rotor profile 26 can include at least one lobe 34 and the stator profile 28 can have $N_L+1$ ($N_L$ is the number of lobes of the rotor profile) cavities 36 for receiving the lobes 34. FIG. 3 shows an exemplary embodiment of the downhole tool 10 wherein the rotor profile 26 includes five lobes 34 and the stator profile 28 includes 6 cavities 36. It should be understood and appreciated that while five lobes 34 and six cavities 36 are shown in FIG. 3, the tool 10 is not limited to any set number of lobes 34 and cavities 36.

Figure 2:
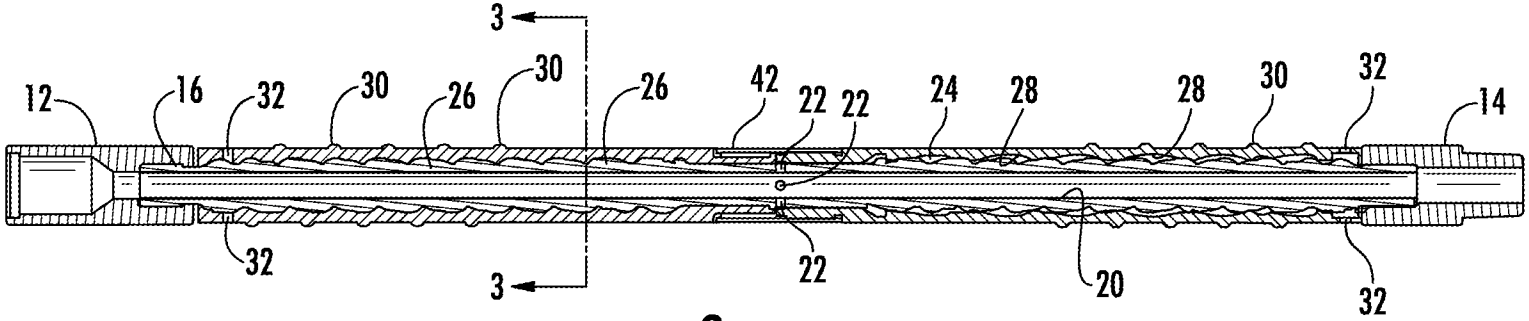
FIG. 2 is a cross-sectional view of the downhole tool shown in FIG. 1 and constructed in accordance with the present disclosure.

In the embodiment shown in FIGS. 1 and 2, the downhole tool 10 includes an upper section 38 and a lower section 40. In this embodiment, the outlet 22 disposed in the central member 16 is positioned between the upper section 38 and the lower section 40, or centrally located on the central member 16. The rotor profile 26 on the central member 16 disposed in the upper section 38 of the tool 10 and the stator profile 28 on the sleeve 18 disposed in the upper section 38 of the tool 10 are designed such that fluid flowing from the internal passageway 20 in the central member 16, through the outlet 22, between the rotor profile 26 and the stator profile 28, and out the exhaust port 32 disposed in the sleeve 18 of the upper section 38 causes the sleeve 18 to rotate and orbit around the upper portion of the central member 16. In this embodiment, the upper portion of the sleeve 18 is caused to rotate and orbit in a clockwise direction when the tool 10 is viewed from the top, facing in the downhole direction. As the upper portion of the sleeve 18 turns, the engaging member 30 interacts with the wellbore or casing, causing motive force to be generated between the tool 10 and the casing or wellbore.

Similarly, the rotor profile 26 on the central member 16 disposed in the lower section 40 of the tool 10 and the stator profile 28 on the sleeve 18 disposed in the lower section 40 of the tool 10 are designed such that fluid flowing from the internal passageway 20 in the central member 16, through the outlet 22, between the rotor profile 26 and the stator profile 28, and out the exhaust port 32 disposed in the sleeve 18 of the lower section 40 causes the sleeve 18 to rotate and orbit around the lower portion of the central member 16. In this embodiment, the lower portion of the sleeve 18 is caused to rotate and orbit in a clockwise direction when the tool 10 is viewed from the top, facing in the downhole direction. It should be understood and appreciated that the rotor profile 26 and the stator profile 28 of the lower section 40 have to be reversed from the rotor profile 26 and the stator profile 28 of the upper section 38 to force the sleeve 18 of the upper section 38 and the sleeve 18 of the lower section 40 to rotate in the same direction. As the lower portion of the sleeve 18 turns, the engaging member 30 interacts with the wellbore or casing causing motive force to be generated between the tool 10 and the casing or wellbore.

In another embodiment, the upper portion and lower portion of the sleeve 18 are separated by a connecting component 42 to provide a transition between the stator profile 28 on the upper portion of the sleeve 18 and the stator profile 28 on the lower portion of the sleeve 18. The connecting component 42 also works to seal the tool 10 at the transition from the upper portion of the sleeve 18 to the lower portion of the sleeve 18. The connecting component 42 would rotate in the same direction as the sleeves 18 in the upper section 38 and the lower section 40.

The engaging member 30 can be anything disposable on the outside of the sleeve 18 that can interact with the wellbore or casing causing motive force to be generated between the tool 10 and the casing or wellbore. The engaging member 30 can be a lip that threads around the outside of the sleeve 18. The engaging member 30 can have blunt or sharp edges to bite into the wellbore or casing. The engaging member 30 can also be angled disks, an elastomeric thread, an elastomeric thread containing hardened metallic material, carbide, and the like. The engaging member 30 can be teeth disposed on the outside of the sleeve 18 and/or a variable pitch thread. The engaging member 30 can also be a combination of any of the components listed as potential engaging members 30 herein.

Figure 4:
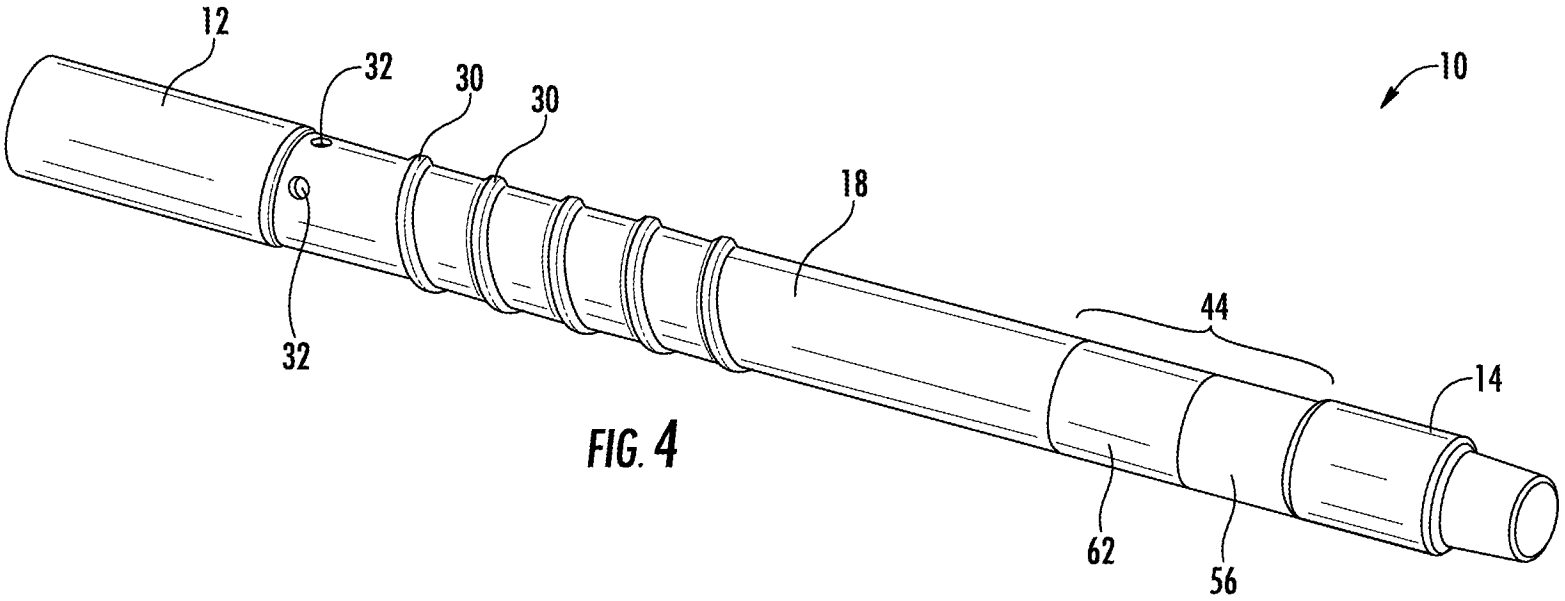
FIG. 4 is a perspective view of another embodiment of the downhole tool constructed in accordance with the present disclosure.
Figure 5:
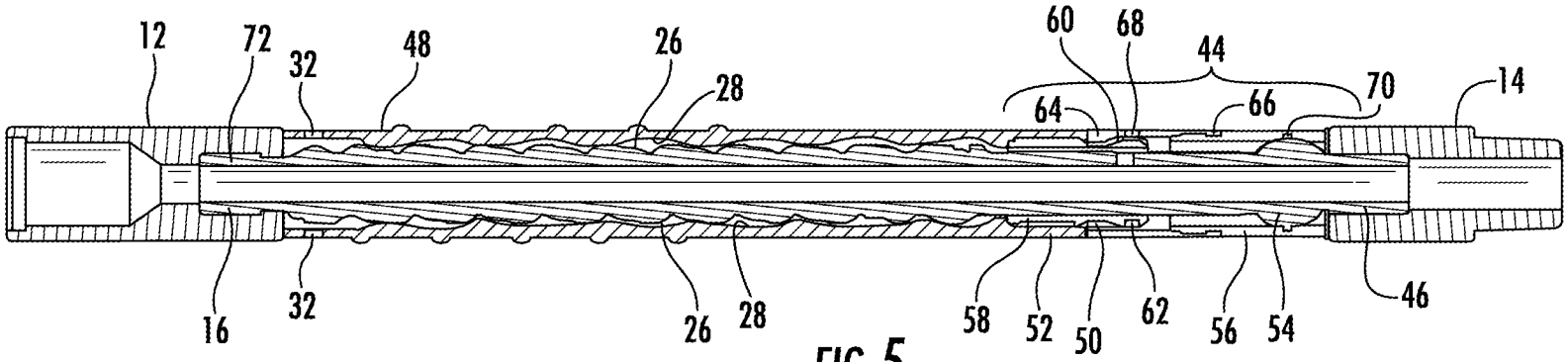
FIG. 5 is a cross-sectional view of the embodiment of the downhole tool shown in FIG. 4 and constructed in accordance with the present disclosure.

In yet another embodiment shown in FIGS. 4 and 5, the downhole tool 10 includes the top adapter 12, the bottom adapter 14, the central member 16, the sleeve 18, and a wobble joint assembly 44 to allow the sleeve 18 to rotate and orbit around the central member 16 and seal the lower end of the tool 10 and prevent fluid from leaking out between the wobble joint assembly 44 and the bottom adapter 14. The downhole tool 10 shown in FIGS. 4 and 5 also includes the outlet 22 disposed in the central member 16 and the exhaust port 32 disposed in the sleeve 18. In this embodiment, the outlet 22 is positioned in a lower portion 46 of the central member 16 and the exhaust port 32 is disposed in an upper portion 48 of the sleeve 18.

In this embodiment, the rotor profile 26 on the central member 16 and the stator profile 28 on the sleeve 18 are designed such that fluid flowing from the internal passageway 20 in the central member 16, through the outlet 22 disposed in the lower portion 46 of the central member 16, between the rotor profile 26 and the stator profile 28, and out the exhaust port 32 disposed in the upper portion 48 of the sleeve 18, causes the sleeve 18 to rotate and orbit around the central member 16. In this embodiment, the sleeve 18 is caused to rotate and orbit in a clockwise direction when the tool 10 is viewed from the top, facing in the downhole direction. As the sleeve 18 turns, the engaging member 30 interacts with the wellbore or casing causing motive force to be generated between the tool 10 and the casing or wellbore.

The wobble joint assembly 44 includes a first spherical element 50 attached to a lower portion 52 of the sleeve 18 and disposed around the lower portion 46 of the central member 16 and a second spherical element 54 disposed on the lower portion 46 of the central member 16 that engages a first transition sleeve 56 disposed around the lower portion 46 of the central member 16 and adjacent to the bottom adapter 14. The first spherical element 50 includes an attachment portion 58 to attach to the sleeve 18 and a spherical portion 60 to handle the rotational and orbital motion of the sleeve 18 around the central member 16.

The wobble joint assembly 44 can also include a second transition sleeve 62 that is supported on a first end 64 by the spherical portion 60 of the first spherical element 50 and a second end 66 attachable to a first transitional sleeve 56. The wobble joint assembly 44 can also include a first sealing element 68 disposed between the spherical portion 60 of the first spherical element 50 and the second transition sleeve 62 and a second sealing element 70 disposed between the second spherical element 54 disposed on the lower portion 46 of the central member 16.

Figure 6:
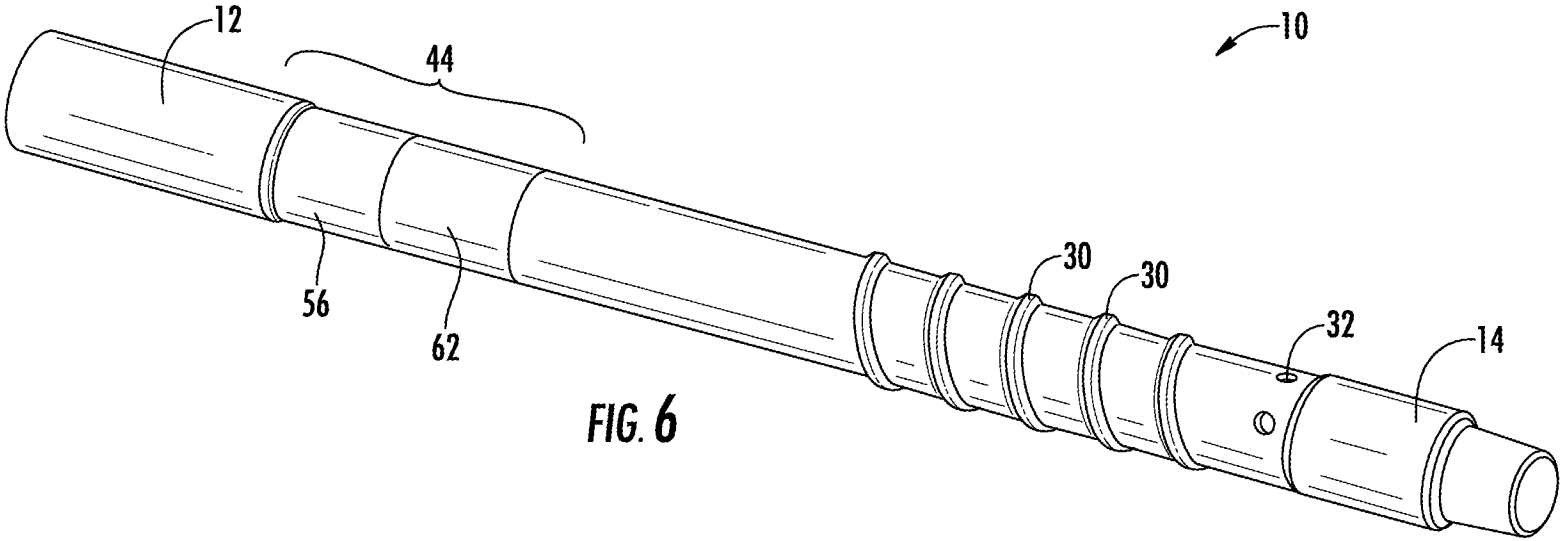
FIG. 6 is a perspective view of another embodiment of the downhole tool constructed in accordance with the present disclosure.
Figure 7:
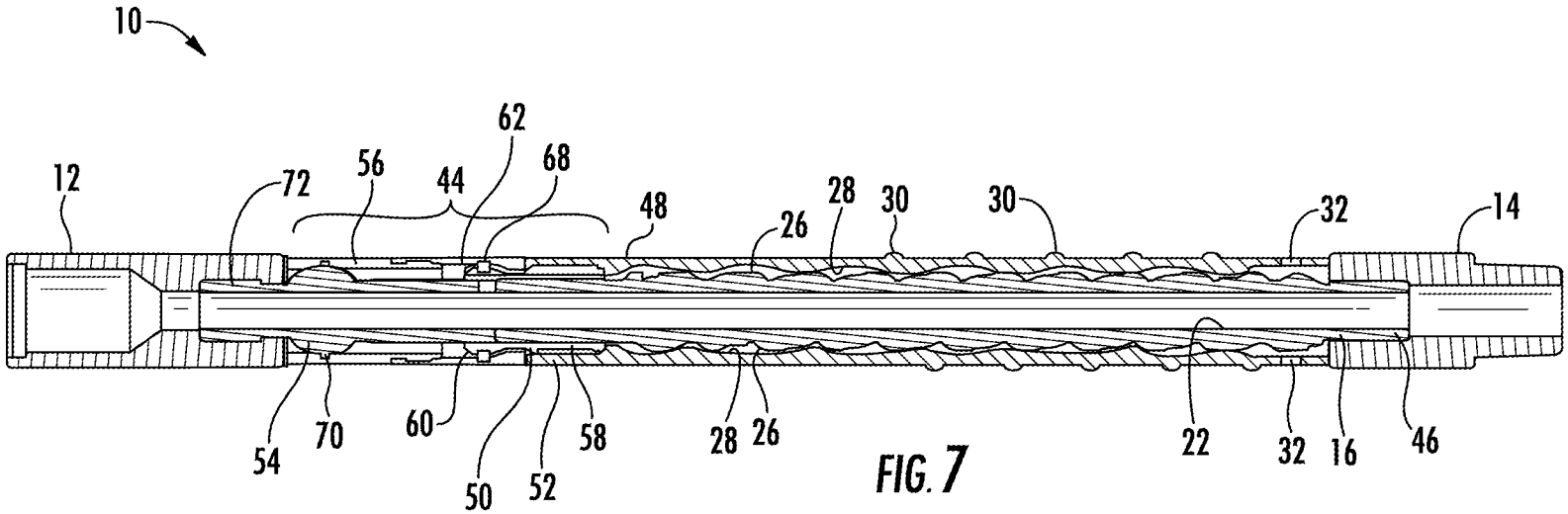
FIG. 7 is a cross-sectional view of the embodiment of the downhole tool shown in FIG. 6 and constructed in accordance with the present disclosure.
Figure 8:
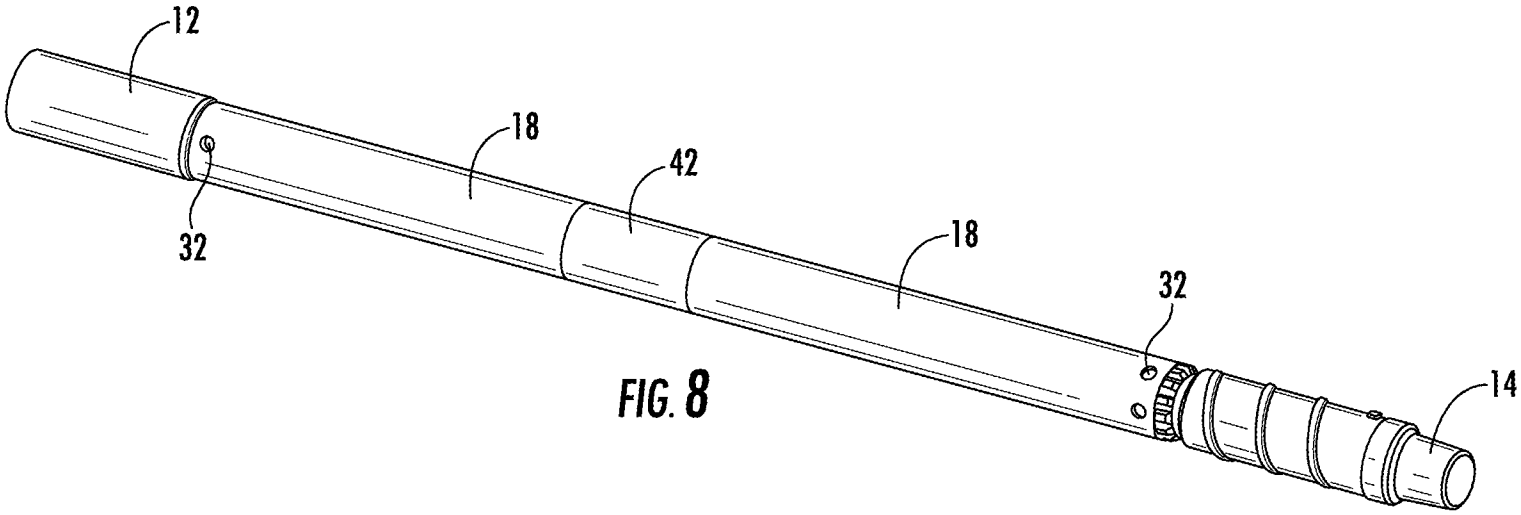
FIG. 8 is a perspective view of another embodiment of the downhole tool constructed in accordance with the present disclosure.
Figure 9:
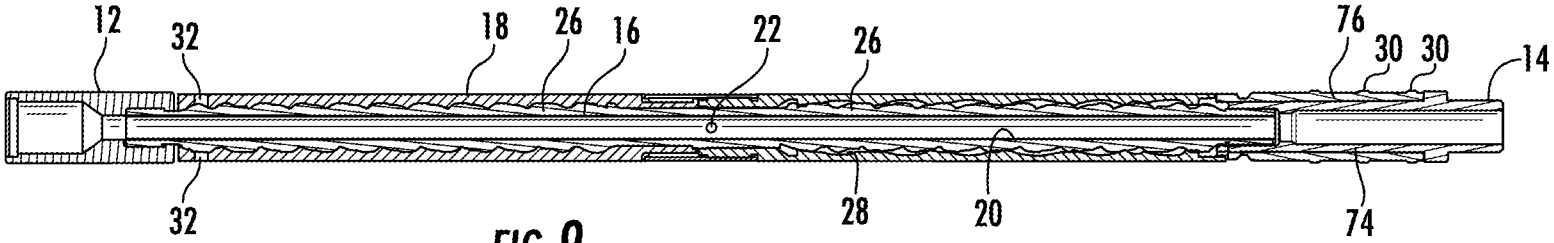
FIG. 9 is a cross-sectional view of the embodiment of the downhole tool shown in FIG. 8 and constructed in accordance with the present disclosure.
Figure 10:
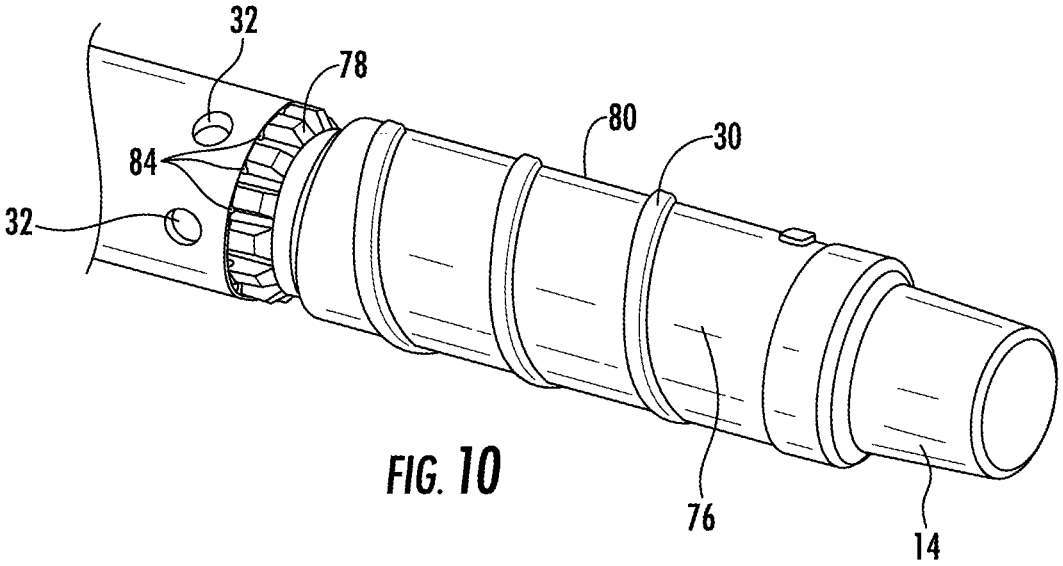
FIG. 10 is a perspective view of a portion of the downhole tool shown in FIG. 8 and constructed in accordance with the present disclosure.
Figure 11:
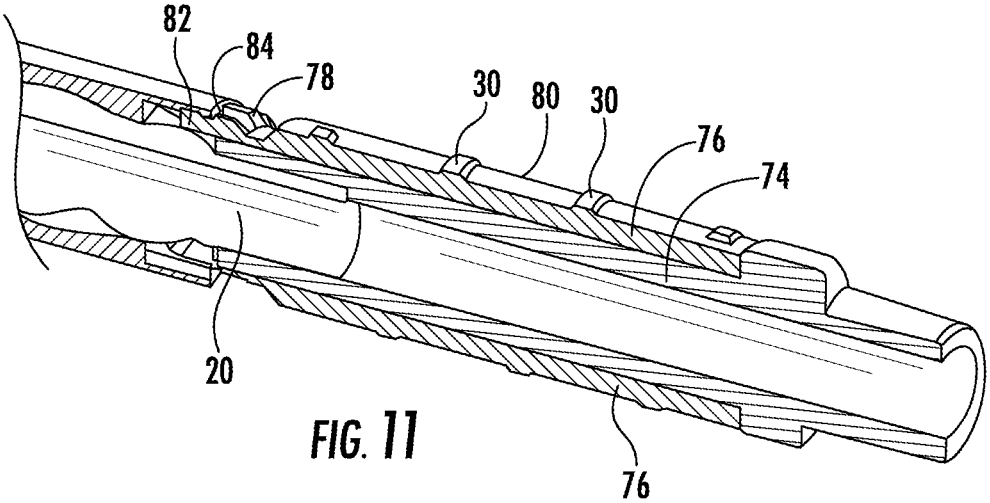
FIG. 11 is a cross-sectional, perspective view of the portion of the downhole tool shown in FIG. 10 and constructed in accordance with the present disclosure.
Figure 12:
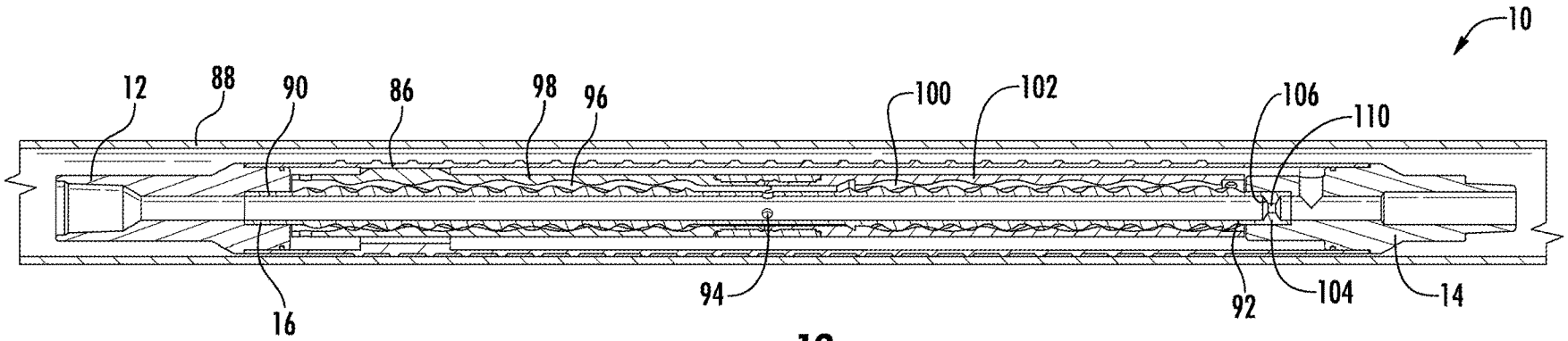
FIG. 12 is a cross-sectional view of another embodiment of the downhole tool and constructed in accordance with the present disclosure.

In yet another embodiment shown in FIGS. 6 and 7 is essentially an inverted version of that described in FIGS. 4 and 5. In this embodiment, the downhole tool 10 includes the top adapter 12, the bottom adapter 14, the central member 16, the sleeve 18, and the wobble joint assembly 44 to allow the sleeve 18 to rotate and orbit around the central member 16 and seal the upper end of the tool 10 and prevent fluid from leaking out between the wobble joint assembly 44 and the top adapter 12. The downhole tool 10 shown in FIGS. 6 and 7 also includes the outlet 22 disposed in the central member 16 and the exhaust port 32 disposed in the sleeve 18. In this embodiment, the outlet 22 is positioned in an upper end 72 of the central member 16 and the exhaust port 32 is disposed in upper portion 48 of the sleeve 18.

In this embodiment, the rotor profile 26 on the central member 16 and the stator profile 28 on the sleeve 18 are designed such that fluid flowing from the internal passageway 20 in the central member 16, through the outlet 22 disposed in the upper end 72 of the central member 16, between the rotor profile 26 and the stator profile 28, and out the exhaust port 32 disposed in the lower portion 52 of the sleeve 18 causes the sleeve 18 to rotate and orbit around the central member 16. In this embodiment, the sleeve 18 is caused to rotate and orbit in a clockwise direction when the tool 10 is viewed from the top, facing in the downhole direction. As the sleeve 18 turns, the engaging member 30 interacts with the wellbore or casing causing motive force to be generated between the tool 10 and the casing or wellbore.

The wobble joint assembly 44 includes the first spherical element 50 attached to the upper portion 48 of the sleeve 18 and disposed around the upper end 72 of the central member 16 and the second spherical element 54 disposed on the upper end 72 of the central member 16 that engages the first transition sleeve 56 disposed around the upper end 72 of the central member 16 and adjacent to the top adapter 12. The first spherical element 50 includes the attachment portion 58 to attach to the sleeve 18 and the spherical portion 60 to handle the rotational and orbital motion of the sleeve 18 around the central member 16.

The wobble joint assembly 44 can also include the second transition sleeve 62 that is supported on the first end 64 by the spherical portion 60 of the first spherical element 50 and the second end 66 attachable to first transitional sleeve 56. The wobble joint assembly 44 can also include the first sealing element 68 disposed between the spherical portion 60 of the first spherical element 50 and the second transition sleeve 62 and the second sealing element 70 disposed between the second spherical element 54 disposed on the upper end 72 of the central member 16.

In yet another embodiment of the present disclosure shown in FIGS. 8-11, the downhole tool 10 can be constructed similarly to the embodiments shown in FIGS. 1 and 2. For example, the tool 10 in this embodiment can include the top and bottom adapters 12 and 14, the central member 16, at least one sleeve 18, the connecting component 42, the internal passageway 20 and the outlet 22 in the central member 16, the at least one exhaust port 32 in the sleeve 18, the rotor profile 26, and/or the stator profile 28.

In this embodiment, the bottom adapter 14 includes an extension element 74 that is connected to the lower portion 46 of the central member 16 and an engaging sleeve 76 rotatably disposed around the extension element 74 of the bottom adapter 14. The engaging sleeve 76 includes at least one engaging member 30 disposed on an outside portion 80 of the engaging sleeve 76 as described herein and a plurality of teeth 78 disposed on a first end 82 of the engaging sleeve 76. The plurality of teeth 78 disposed on the first end 82 of the engaging sleeve 76 engage a second set of teeth 84 disposed on the inside of the lower portion 52 of the sleeve 18.

The plurality of teeth 78 on the engaging sleeve 76 and the second set of teeth 84 are designed such that the rotational speed of the engaging sleeve 76 around the extension element 74 of the bottom adapter 14 can be set to a predetermined rotational speed. For example, the teeth 78,84 can be spaced, sized and shaped in different variations to accomplish the desired rotational speed of the engaging sleeve 76. The teeth 78,84 can be designed such that the engaging sleeve 76 rotates at a rate less than the sleeve 18. The teeth 78,84 can even be designed such that the engaging sleeve 76 rotates in the opposite direction of the sleeve 18.

As described herein, the sleeve 18 is caused to rotate and orbit around the central member 16 when fluid is slowed through the tool 10. The rotation and orbit of the sleeve 18 causes the second set of teeth 84 to rotate and orbit around the plurality of teeth 78 disposed on the first end 82 of the engaging sleeve 76. As the teeth 84 of the sleeve 18 rotate and orbit around the teeth 78 disposed on the engaging sleeve 76, the teeth 78 are only partially engaged by the teeth 84 at any given moment. Thus, the teeth 78 are progressively engaged as the sleeve 18 turns the teeth 84 outside the central member 16. In other words, each tooth 78 is substantially engaged for one instant by a portion of the teeth 84 and is then progressively unengaged as the sleeve 18, and thus the teeth 84, continues to turn.

Referring now to FIGS. 12-17, shown therein is yet another embodiment of the present disclosure. In this embodiment, the downhole tool 10 includes the top adapter 12, the bottom adapter 14 and the central member 16, as previously disclosed herein. The downhole tool 10 also includes an outer sleeve 86 that is rotatably supported by the top and bottom adapters 12 and 14. The outer sleeve 86 engages with casing 88 to force the downhole tool 10 further into the casing 88 when resistance is met.

The central member 16 includes the internal passageway 20 in fluid communication with the top and bottom adapters 12, 14, an upper portion 90, a lower portion 92 and a central outlet 94 disposed between the upper portion 90 and lower portion 92 of the central member 16. The central outlet 94 allows a portion of the fluid passing into the internal passageway 20 to exit the internal passageway 20 and enter a first annulus 96 disposed between the upper portion 90 of the central member 16 and an upper sleeve 98. Concurrently, the fluid exiting the internal passageway 20 via the central outlet 94 flows into a second annulus 100 disposed between the lower portion 92 of the central member 16 and a lower sleeve 102. It should be understood that the central outlet 94 can be comprised of multiple openings disposed in the central member 16. The upper sleeve 98 and the lower sleeve 102 are disposed between the central member 16 and the outer sleeve 86.

Figure 13:
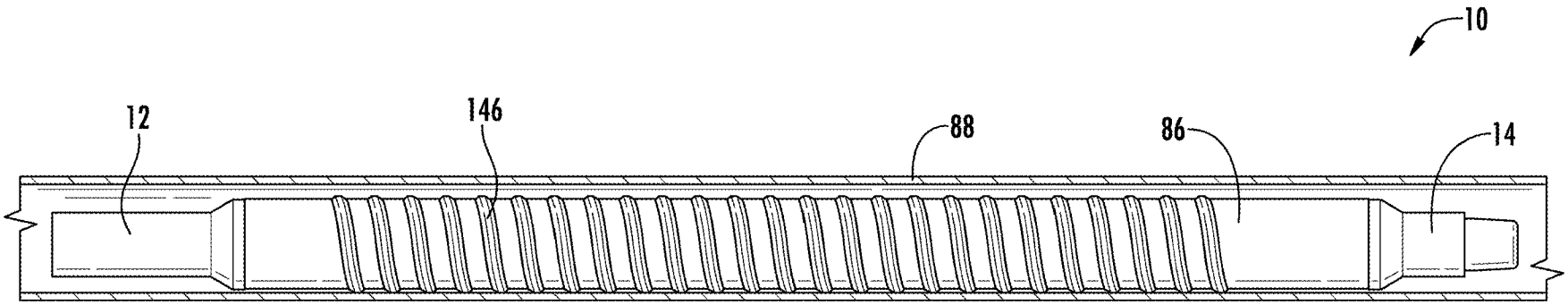
FIG. 13 is a side elevation view of the downhole tool shown in FIG. 12 and constructed in accordance with the present disclosure.
Figure 14:
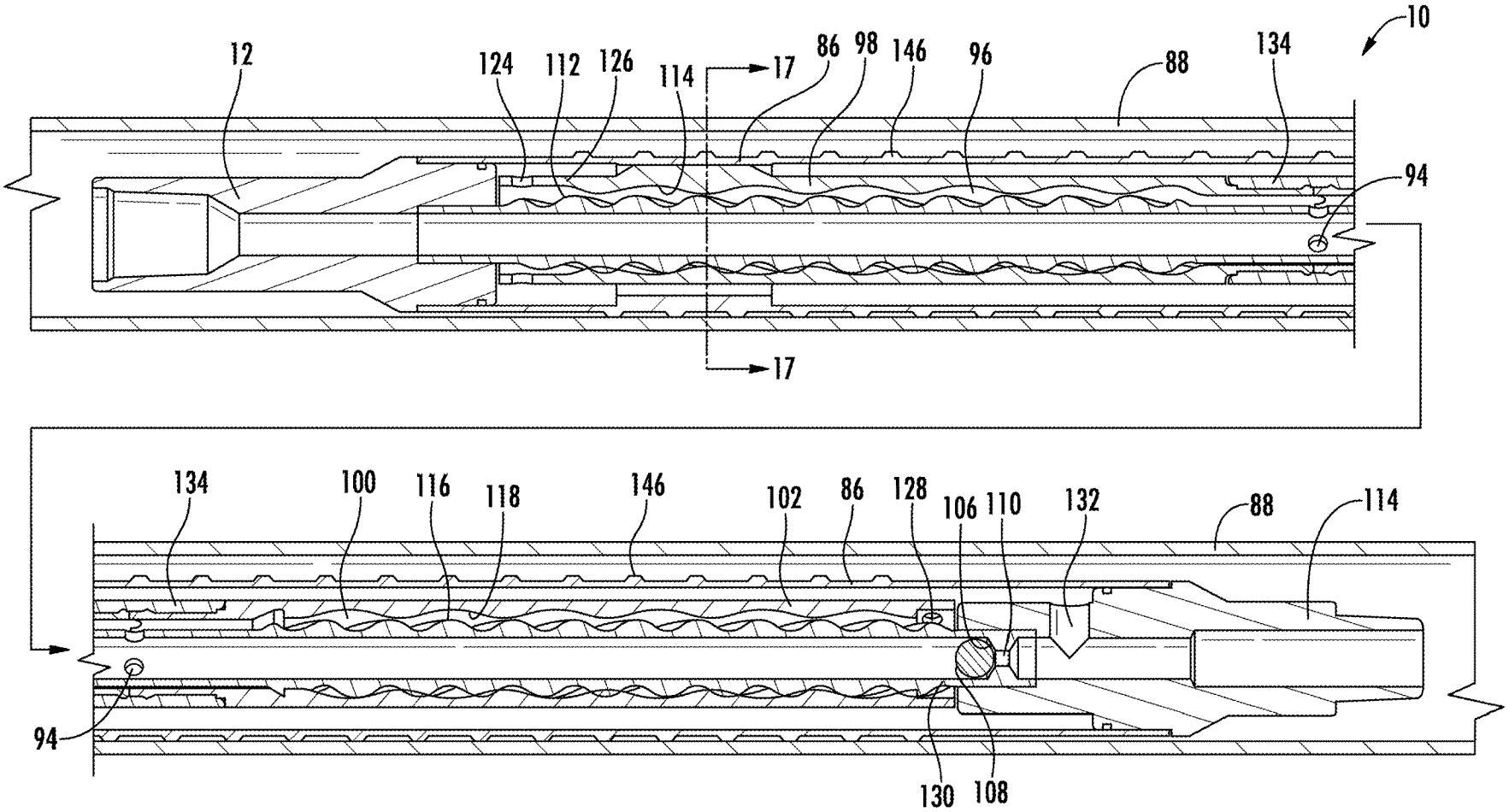
FIG. 14 is a close-up cross-sectional view of that shown in FIG. 12.
Figure 15:
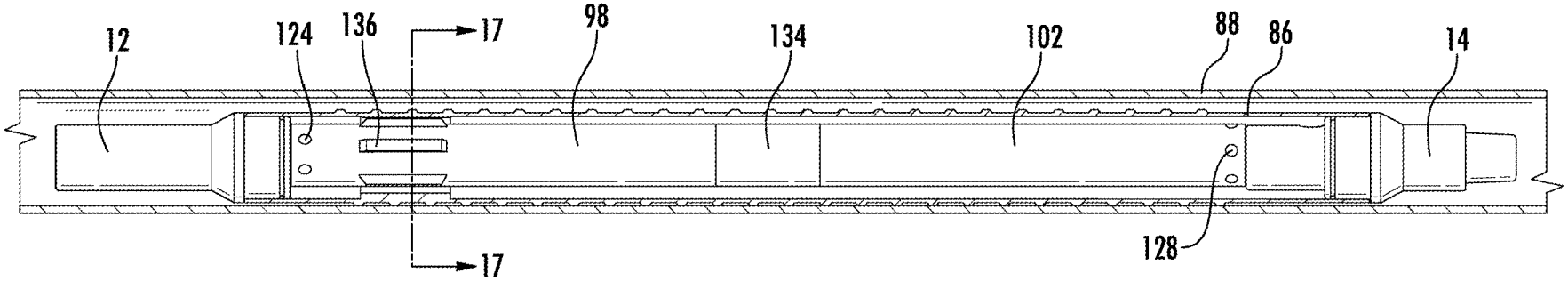
FIG. 15 is a partial cross-sectional and partial side elevation view of the downhole tool shown in FIGS. 12 and 13.
Figure 16:
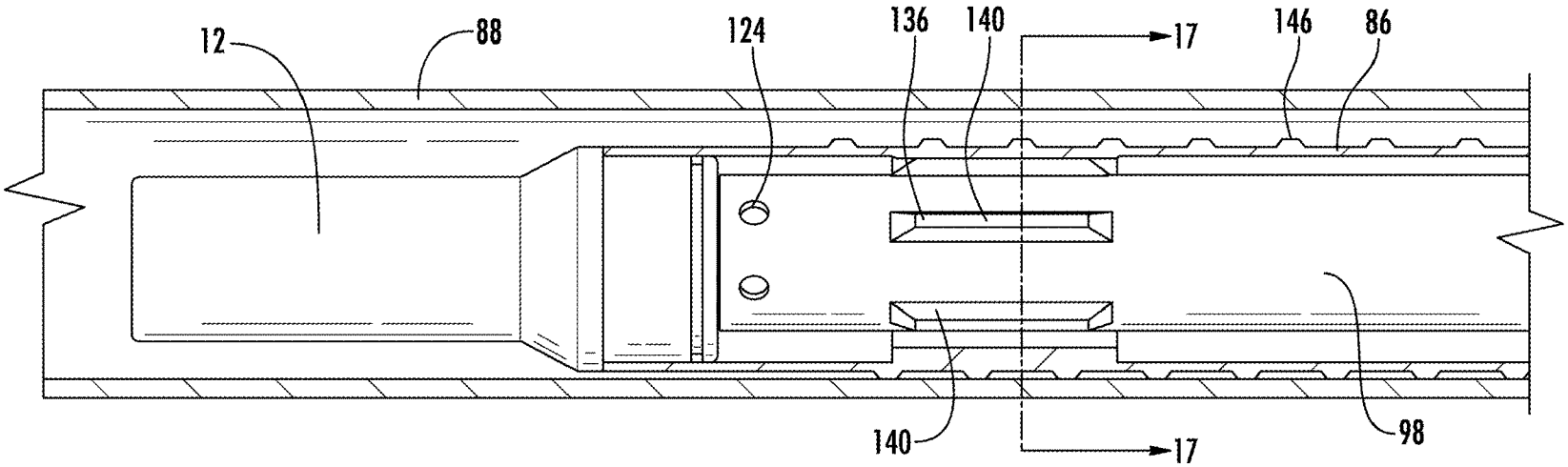
FIG. 16 a close-up view of a portion of the downhole tool shown in FIG. 15.

Shown in FIGS. 13 and 14, the central member 16 has a downhole end 104 that can be designed in a multitude of ways. In one embodiment, the downhole end 104 of the central member 16 is closed (not shown) and fluid is not permitted to flow through. In another embodiment, the downhole end 104 can be open to allow fluid to pass through and include a seat 106 disposed therein to receive a fluid blocking member 108 to selectively block the flow of fluid through the downhole end 104 of the central member 16 when it is desirable to activate the downhole tool 10. In yet another embodiment, the downhole end 104 can include a restricted opening 110 that will permit some fluid to pass through, but also force fluid to exit the internal passageway 20 of the central member 16.

The upper portion 90 of the central member 16 includes a first rotor profile 112 disposed thereon to cooperate with a first stator profile 114 disposed on an internal portion of the upper sleeve 98. The first rotor profile 112 cooperates with the first stator profile 114 to force the upper sleeve 98 to rotate and orbit around the central member 16. Similarly, the central member 16 includes a second rotor profile 116 disposed thereon to cooperate with a second stator profile 118 disposed on an internal portion of the lower sleeve 102. The second rotor profile 116 cooperates with the second stator profile 118 to force the lower sleeve 102 to rotate and orbit around the central member 16.

Figure 17:
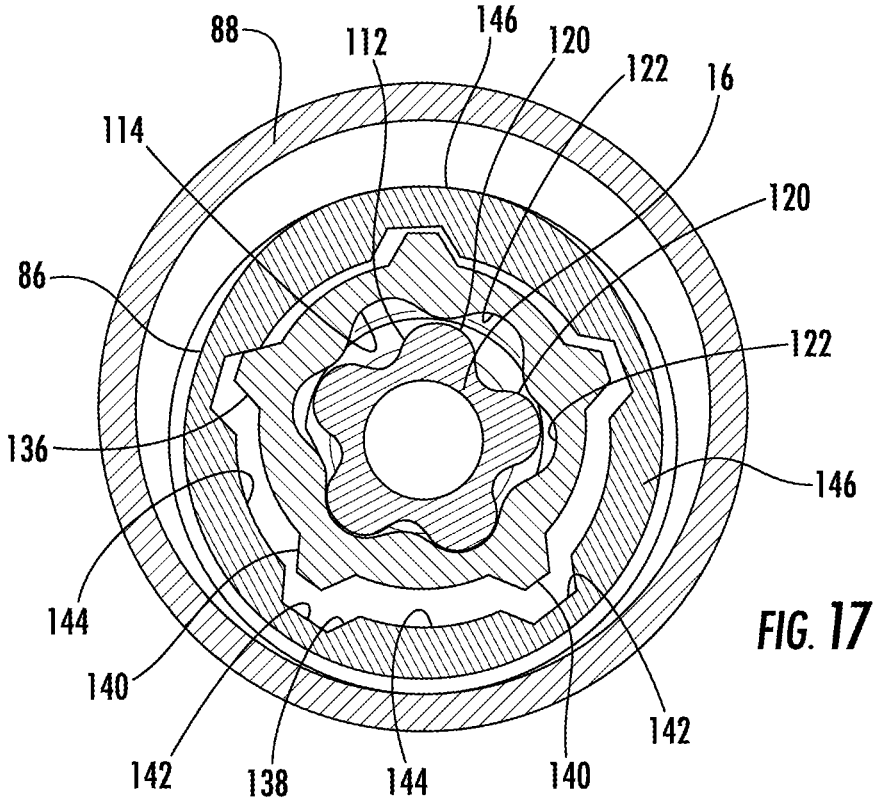
FIG. 17 is a cross-sectional view of the tool shown across the line 17-17 in FIGS. 15 and 16.
Figure 18:
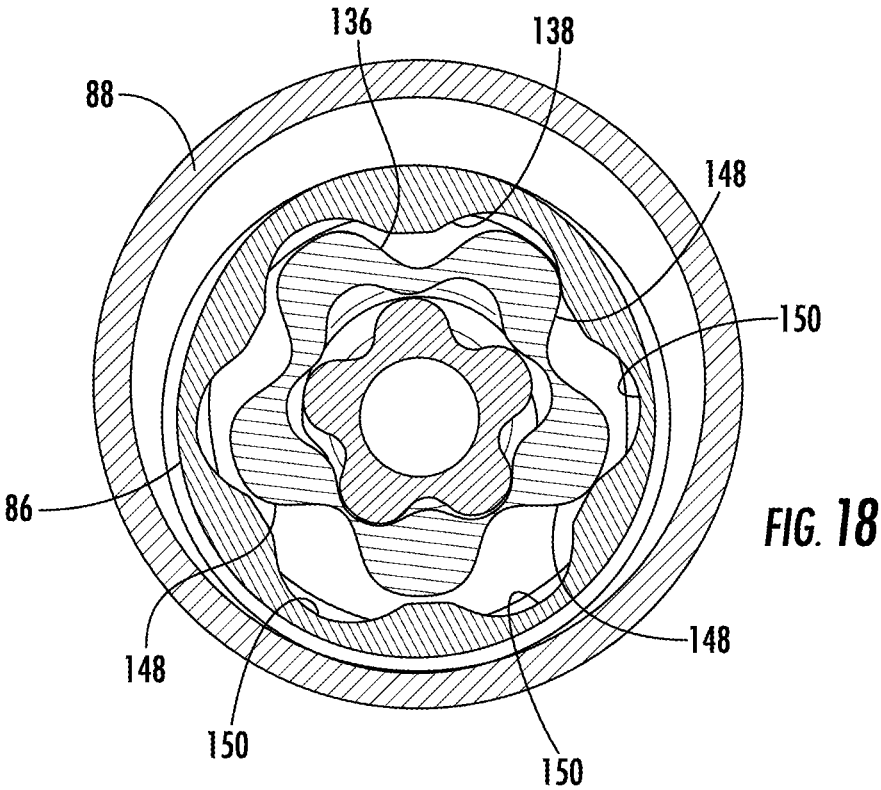
FIG. 18 is a cross-sectional view of another embodiment of the downhole tool constructed in accordance with the present disclosure.
Figure 19A:
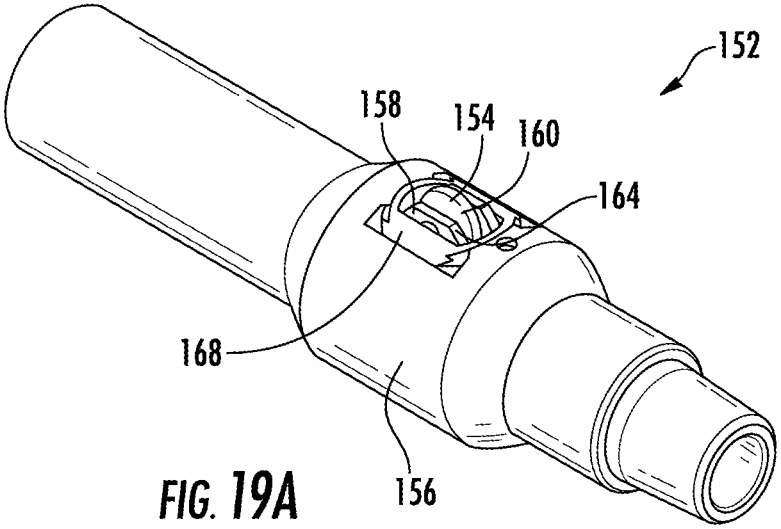
FIG. 19A is a perspective view of a side-load apparatus used in accordance with the present disclosure.
Figure 19B:
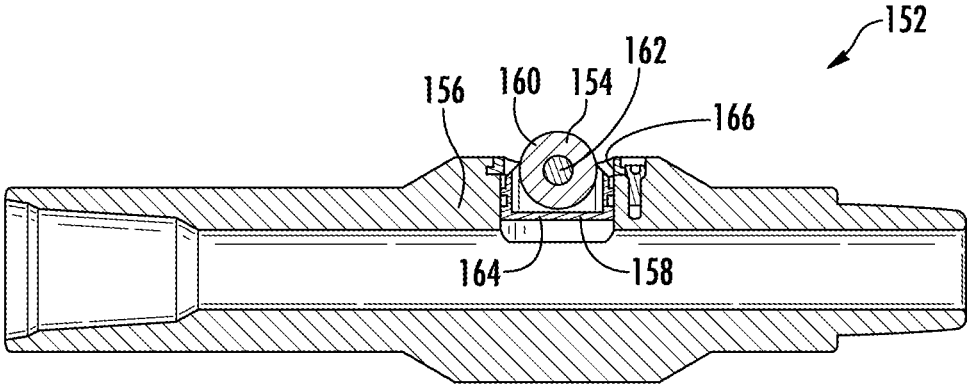
FIG. 19B is a cross-sectional view of the side-load apparatus shown in FIG. 19A.
Figure 19C:
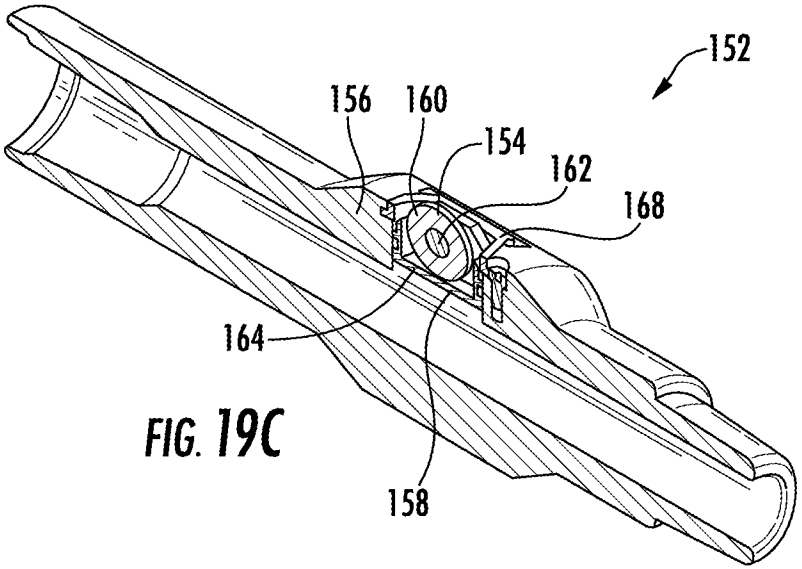
FIG. 19C is a perspective and cross-sectional view of the side-load apparatus shown in FIGS. 19A and 19B.
Figure 20:
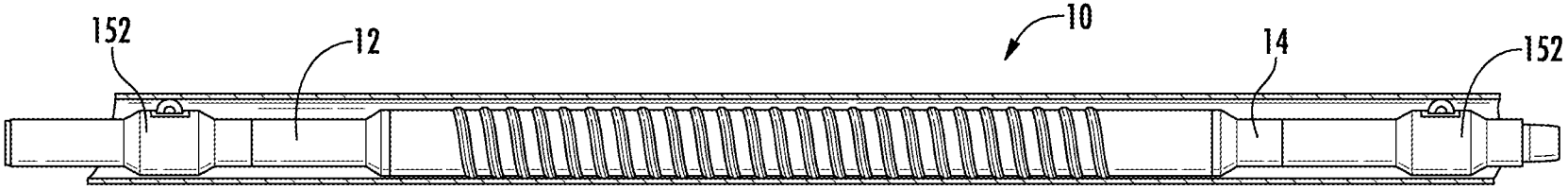
FIG. 20 is a side elevation view of one embodiment of the downhole tool incorporating the side-load apparatus described herein.
Figure 21:
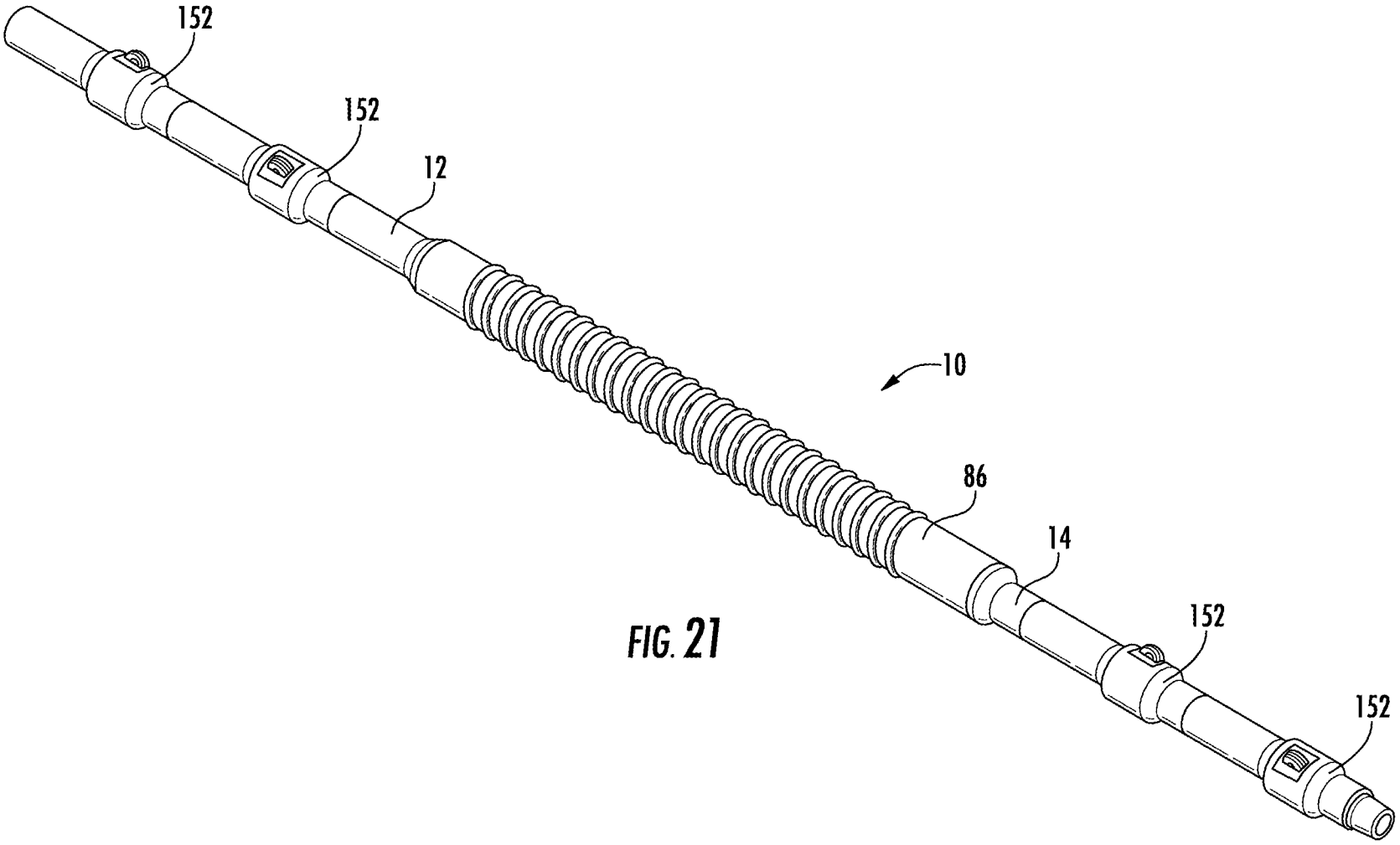
FIG. 21 is a perspective view of one embodiment of the downhole tool incorporating a plurality of side-load apparatuses described herein.

Referring now to FIGS. 17 and 18, the rotor profiles 112, 116 and the stator profiles 114, 118 are similar to and cooperate like the rotor profile 26 and the stator profile 28 previously described herein for the previous embodiments. The first or second rotor profiles 112 or 116 can include at least one lobe 120 and the first or second stator profiles 114 or 118 can have $N_L+1$ ($N_L$ is the number of lobes of the rotor profile) cavities 122 for receiving the lobes 120. FIGS. 17 and 18 shows an exemplary embodiment of the downhole tool 10 wherein the rotor profiles 112, 116 include five lobes 120 and the stator profiles 114, 118 includes 6 cavities 122. It should be understood and appreciated that while five lobes 120 and six cavities 122 are shown in FIGS. 17 and 18, the tool 10 is not limited to any set number of lobes 120 and cavities 122.

To rotate the upper and lower sleeves 98 and 102 around the central member 16, fluid has to be pumped into the internal passageway 20 of the central member 16 and out the central outlet 94 disposed in the central member 16. A portion of the fluid will flow into the first annulus 96 and travel between the first rotor profile 112 and the first stator profile 114 to force the upper sleeve 98 to rotate and orbit around the central member 16, which is statically disposed between the top adapter 12 and the bottom adapter 14. The fluid is permitted to exit the first annulus 96 via an opening(s) 124 disposed in an uphole end 126 of the upper sleeve 98. Another portion of the fluid will flow into the second annulus 100 and travel between the second rotor profile 116 and the second stator profile 118 to force the lower sleeve 102 to rotate and orbit around the central member 16. The fluid is permitted to exit the second annulus 100 via an opening(s) 128 disposed in a downhole end 130 of the lower sleeve 102. It should be understood and appreciated that the fluid flowing through the first and second annuluses 96, 100 causes the upper and lower sleeves 98, 102 to orbit and rotate via the same principles that causes a rotor to rotate and orbit inside a stator in a moineau principle pump/motor. In one embodiment, the openings 124 and 128 can be disposed in the upper and lower sleeves 98 and 102 in the radial direction.

Fluid exiting the first and second annuluses 96, 100 via the openings 124 and 128, respectively, flows between the upper and lower sleeves 98, 102 and the outer sleeve 86. The fluid can then flow through a radial port 132 disposed in the bottom adapter 14 of the downhole tool 10 and out of the downhole tool 10.

It is desirous that the upper and lower sleeves 98, 102 rotate and orbit in the same direction so as to force the outer sleeve 86 to rotate in the same direction. To accomplish this, the first rotor profile 112 and the first stator profile 114 is essentially reversed from the second rotor profile 116 and the second stator profile 118 because the fluid used to rotate and orbit the first stator profile 114 (and thus the upper sleeve 98) around the first rotor profile 112 flows in the uphole direction in the first annulus 96. Conversely, the fluid used to rotate and orbit the second stator profile 118 (and thus the lower sleeve 102) around the second rotor profile 116 flows in the downhole direction in the second annulus 100. It should be understood and appreciated that the downhole tool 10 can be designed such that the upper sleeve 98 and lower sleeve 102 can rotate in either direction such that it causes the outer sleeve 86 to properly engage the casing 88 and force the downhole tool 10 in the downhole direction.

In another embodiment, the upper sleeve 98 and the lower sleeve 102 are coupled together by a connecting component 134 to provide a transition between the first stator profile 114 and the second stator profile 118. The connecting component 134 also works to seal the tool 10 at the transition from the upper sleeve 98 to the lower sleeve 102. The connecting component 134 would rotate in the same direction as the sleeves 98, 102. The upper and lower sleeves 98, 102 can be rigidly connected with the connecting component 134 so the upper sleeve 98, the connecting component 134 and the lower sleeve 102 all orbit and rotate together around the central member 16.

The upper sleeve 98 and/or the lower sleeve 102 can transfer its rotating and orbiting motion (acting like a planetary gear) to rotate the outer sleeve 86 via a first gearing element 136 disposed on an outer portion of the upper sleeve 98 and/or the lower sleeve 102 that cooperates with a second gearing element 138 disposed on an inner portion of the outer sleeve 86. The first gearing element 136 and/or the second gearing element 138 can be any type of gearing hardware known in the art, such as, gear teeth, lobes, cavities, nodes, etc. FIGS. 13-16 show the first gearing element 136 disposed on the outer portion of the upper sleeve 98. The first gearing element 136 can be disposed on the upper sleeve 98 and/or the lower sleeve 102 at any length desirable and can be disposed in a substantially straight axial relationship to the upper sleeve 98 and/or the lower sleeve 102. Similarly, the second gearing element 138 can be disposed on the inner portion of the outer sleeve 86 at any length desirable and can be disposed in a substantially straight axial relationship to the outer sleeve 86.

FIG. 17 shows the first gearing element 136 as teeth 140 disposed on the outside of the upper sleeve 98 or the lower sleeve 102 and the second gearing element 138 as cavities 142 disposed on the inner portion of the outer sleeve 86. It should be understood that while the cavities 142 are more easily referenced in FIG. 17, the protruding portions 144 from the inner part of the outer sleeve 86 are nothing more than wide teeth.

Disposed on the outside of the outer sleeve 86 is at least one engaging member 146 to engage a wellbore or the casing 88 disposed in the wellbore. Similar to the engaging member 30 previously disclosed herein, the engaging member 146 can be anything disposable on the outside of the outer sleeve 86 that can interact with the wellbore or the casing 88 causing motive force to be generated between the downhole tool 10 and the casing 88 or wellbore. The engaging member 146 can be a lip that threads around the outside of the outer sleeve 86. The engaging member 146 can have blunt or sharp edges to bite into the wellbore or the casing 88. The engaging member 146 can also be angled disks, an elastomeric thread, an elastomeric thread containing hardened metallic material, carbide, and the like. The engaging member 146 can be teeth disposed on the outside of the outer sleeve 146 and/or a variable pitch thread. The engaging member 146 can also be a combination of any of the components listed as potential engaging members 146 herein.

The rate at which the outer sleeve 86 rotates relative to the rate at which the upper sleeve 98 and/or the lower sleeve 102 rotates can be altered by the design of the first gearing element 136 and the design of the second gearing element 138. FIG. 17 shows the first gearing element 136 having five (5) teeth 140 and the second gearing element 138 having five (5) corresponding cavities 142 (or protruding portion 144). The first gearing element 136 being equal in number to the second gearing element 138 shown in FIG. 17 corresponds to the outer sleeve 86 rotating at the same rate as the upper sleeve 98 and/or the lower sleeve 102. FIG. 18 shows an embodiment where the first gearing element 136 is less than the second gearing element 138, which reduces the rate the outer sleeve 86 rotates relative to the upper sleeve 98 and/or the lower sleeve 102. More specifically in this embodiment, the first gearing element 136 includes five (5) gearing lobes 148 disposed on the outer portion of the upper sleeve 98 and/or the lower sleeve 102 and the second gearing element 138 includes six (6) gearing cavities 150 disposed on the inner portion of the outer sleeve 86. It should be understood and appreciated that, while FIG. 18 shows lobes and cavities as the gearing elements 136 and 138, a plurality of teeth can be used as well.

The number of teeth, lobes, cavities and the like used to create the first gearing element 136 on the upper sleeve 98 and/or the lower sleeve 102 can be varied, as well as the size and shape, so as to achieve the desired rate of rotation of the outer sleeve 86. Similarly, the number of teeth, lobes, cavities and the like used to create the second gearing element 138 on the inside of the outer sleeve 86 can be varied, as well as the size and shape, so as to achieve the desired rate of rotation of the outer sleeve 86. Furthermore, the teeth, lobes, cavities and the like of the first gearing element 136 and/or the second gearing element 138 can be designed such that the outer sleeve 86 rotates at a rate less than the upper sleeve 98 and/or the lower sleeve 102. The teeth, lobes, cavities and the like of the first gearing element 136 and/or the second gearing element 138 can be designed such that the outer sleeve 86 rotates in the opposite direction of the upper sleeve 98 and/or the lower sleeve 102.

In yet another embodiment of the present disclosure shown in FIGS. 19A-21, the downhole tool 10 can include a side-load apparatus 152 to force the downhole tool 10 into contact with the casing 88. The side-load apparatus 152 includes a casing engaging member 154 that can selectively extend and retract radially from a housing 156. The casing engaging member 154 is forced into one side of the casing 88 which forces the downhole tool 10 into the opposite side of the casing 88. The side-load apparatus 152 can also include a driving element 158 to provide the expulsion force to the casing engaging member 154. It should be understood and appreciated that the side-load apparatus 152 can be used with any embodiment of the downhole tool 10 described herein.

The housing 156 can be disposed in any part of the downhole tool 10 such that the side-load apparatus 152 can force the downhole tool 10 into one side of the casing 88. In one embodiment, the housing 156 can be disposed in uphole or downhole from the top adapter 12 and/or the bottom adapter 14. In another embodiment, the housing 156 can be included as a part of the top adapter 12 and/or the bottom adapter 14. FIG. 19 shows the housing 156 for the side-load apparatus 152 as part of the top adapter 12 and the bottom adapter 14. In yet another embodiment shown in FIG. 21, the downhole tool 10 includes four (4) of the side-load apparatuses 152 with the housings 156 thereof disposed in various locations on the downhole tool 10. It should be understood and appreciated that the downhole tool 10 can include any number of the side-load apparatuses 152 such that the downhole tool 10 is sufficiently forced into one side of the casing 88.

The casing engaging member 154 can be any device capable of being extended from the housing 156, handling the force required to push the downhole tool 10 sufficiently into the casing 88, and being able to traverse along the casing 88 as the downhole tool 10 is forced in the downhole direction. In one embodiment shown in FIGS. 19A-19C, the casing engaging member 154 is a roller/wheel 160 that is rotatably supported by the housing 156. More specifically, the roller/wheel 160 can be rotatably supported by a pin 162 attached to a hydraulic piston 164 that is disposed in an axial opening 166 in the housing 156. The hydraulic piston 164 is one example of a driving element 158 to force the casing engaging member 154 to interact with the casing 88.

The pressure of the fluid flowing through the downhole tool 10 will force the hydraulic piston 164 outward, and thus, the roller/wheel into the casing 88. In this embodiment, the side-load apparatus 152 can include a restraint element 168 disposed in the axial opening 166 above the hydraulic piston 164 to keep the hydraulic piston 164 and roller/wheel 160 from separating from the side-load apparatus 152.

The driving element 158 can be the hydraulic piston 164 disclosed herein. The driving element 158 can be any type of device capable of forcing the casing engaging member 154 to engage the casing 88 and force the downhole tool 10 to properly engage the other side of the casing 88. A compression spring can also be used instead of hydraulic force to drive the casing engaging member 154 forcibly against the inside portion of the casing 88. Other examples of driving elements 158 include springs, such as a bow spring, hydraulically actuated arms, mechanical linkages, drag block devices, fluid jets which create a lateral thrust load on the force generating tool, and the like.

The present disclosure is also directed toward a method of using the downhole tool 10 and/or method of forcing and/or advancing the downhole tool 10 into a wellbore. The method includes placing the downhole tool 10 into a wellbore. Fluid can then be provided to the downhole tool 10 to facilitate the rotation and orbiting of the sleeve 18, the upper sleeve 98 and/or the lower sleeve 102 around the central member 16. As the sleeves 18, 98, or 102 rotate and orbit, it causes the engaging members 30 or 146 to enact with the inside of the wellbore. This provides motive force to the downhole tool 10 which forces the downhole tool 10 further into the well.

From the above description, it is clear that the present disclosure is well adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A downhole tool, the tool comprising:

a central element having an outlet disposed therein to permit fluid to flow from a passageway disposed through the central element into an annulus area, the outlet in the central element open during all operations of the downhole tool; and a sleeve rotatably and orbitally disposed around the central element, the sleeve rotates around the central element responsive to fluid flowing through the downhole tool and includes an exhaust port disposed therein uphole from the outlet disposed in the central element to permit fluid to flow from the annulus area to outside of the downhole tool, the annulus area disposed between the central element and the sleeve.

2. The tool of claim 1 wherein the central element has a rotor profile disposed thereon and the sleeve has a stator profile disposed on the inside to cooperate with the rotor profile to force the sleeve to rotate and orbit around the central member as fluid flows from the passageway, through the outlet in the central member, between the central member and the sleeve and out of the exhaust port.

3. The tool of claim 2 wherein the rotor profile of the central element includes at least one lobe disposed thereon.

4. The tool of claim 3 wherein the stator profile of the sleeve includes a plurality of cavities disposed thereon for receiving the at least one lobe disposed on the central element.

5. The tool of claim 1 wherein the downhole tool further includes a top adapter for attaching the downhole tool to another tool disposed in a bottom hole assembly (BHA) disposed above the downhole tool.

6. The tool of claim 1 wherein the downhole tool further includes a bottom adapter for attaching the downhole tool to another tool disposed in a bottom hole assembly (BHA) disposed below the downhole tool.

* * * * *